United States Patent [19]

Burns

[11] 4,331,445

[45] May 25, 1982

[54] REDUCTION OF SPONTANEOUS COMBUSTION OF COAL

[75] Inventor: Edward J. Burns, Omaha, Nebr.

[73] Assignee: InterNorth, Omaha, Nebr.

[21] Appl. No.: 250,661

[22] Filed: Apr. 3, 1981

[51] Int. Cl.[3] ..... C10L 9/02; C10L 5/24

[52] U.S. Cl. ..... 44/6; 44/1 R

[58] Field of Search ..... 44/6, 1 R; 252/601, 252/610; 106/18.11

[56] References Cited

U.S. PATENT DOCUMENTS

| | | | |
|---|---|---|---|
| 2,222,370 | 0/1940 | Mori | 44/6 |
| 3,226,355 | 0/1965 | Singleton et al. | 106/18.11 |
| 4,214,875 | 0/1980 | Kromrey | 44/6 |

OTHER PUBLICATIONS

Baichenko, A. A., "Thickening and Filtration of Coal Floatation Tailings", 1974 (11), 60–1, Russia, *Chemical Abstract,* vol. 82, 1975, p. 149.

*Primary Examiner*—Carl F. Dees
*Assistant Examiner*—Margaret B. Medley
*Attorney, Agent, or Firm*—Donald F. Haas

[57] ABSTRACT

A composition for the prevention of spontaneous combustion of coal is described which is comprised of at least about 2 percent of polyethylene oxide and the balance water. Also described is a method for reducing the spontaneous combustion tendency of coal by contacting coal with the above composition and then drying the coal.

5 Claims, No Drawings

REDUCTION OF SPONTANEOUS COMBUSTION OF COAL

The expected decrease in the availability of premium fuels has focused attention on the resource potential of low-rank coals (sub-bituminous coals and lignites), which have a heating value of less than 13,000 BTU per pound. There are an estimated 485 billion tons of sub-bituminous coal and 478 billion tons of lignite in the United States, mostly in the continental states west of the Mississippi River. Increased production and utilization of low-rank western coals present many problems, both technical and economic. One serious problem associated with mining, transportation, and storage of low-rank coals is spontaneous combustion. Fires due to spontaneous combustion of coal may occur in the high wall of surface mines, on transporting the coal, or in storage piles of the coal, and present a potentially fatal hazard in underground mines.

Spontaneous combustion, which is a common problem with some European and Soviet coals, has been the subject of research for over 100 years. This research has identified some of the important factors in spontaneous combustion as changes in the moisture content of the coal, air flow rate, particle size, temperature, pyrite content, geological factors, and mining practice. At present, however, there is no simple, universally applicable test for combustibility, no generally accepted index of combustibility, and no simple effective method of preventing spontaneous combustion. Prevention is normally based on suppressing the factors that favor spontaneous combustion, such as accumulation of fine coal particles, inefficient heat dissipation, and differences in the moisture content of the air and the coal. Control of spontaneous combustion is usually based on previous experience and includes mining practice to reduce risk and to detect incipient combustion before a fire occurs.

The method of the present invention provides a simple and relatively inexpensive method for reducing the spontaneous combustion tendency of coal. The prevention methods currently in use include compaction of coal piles to reduce the oxygen in the space surrounding the coal particles, controlling the aging of the coal by reacting warm coal with air and then cooling it, and storing the coal in sealed containers.

U.S. Pat. No. 2,184,621, patented Dec. 26, 1939, discloses a method for treating coal which decreases its tendency to degradate due to slacking or spontaneous ignition. The coal is treated with a crystallizable solution consisting of a paraffin wax and a liquid hydrocarbon. The coating is said to have sufficient fluidity to penetrate and seal the fissures and pores of the coal and prevent oxidation by the elements. However, the wax-hydrocarbon mixture must be applied hot and is not miscible with surface moisture. These factors may result in incomplete coverage which could allow oxidation and even combustion to occur. In the present invention, the polyethylene oxide solutions are completely miscible with surface moisture and should be applied at ambient temperature (greater than 0° C.). This favors a more uniform and continuous coating and thus better resistance to oxidation.

Another known means of preventing spontaneous combustion of coal is the spraying of latex rubber onto the coal. Neither this method nor the method described in the preceding paragraph is the same as or as effective as the use of polyethylene oxide solutions as contemplated in the present invention.

SUMMARY OF THE INVENTION

Briefly described, the invention is a composition for the prevention of spontaneous combustion of coal which is comprised of at least about 2 percent polyethylene oxide and the balance water. Also described is a method for reducing the spontaneous combustion tendency of coal which comprises contacting coal with the afore-described composition, and then drying the coal. It is preferred that the composition be sprayed onto the coal.

DETAILED DESCRIPTION OF THE INVENTION

Polyethylene oxide is a crystalline, thermoplastic, water soluble polymer with the general formula $HOCH_2(CH_2OCH_2)_nCH_2OH$ or $H(OCH_2CH_2)_nOH$. The end groups are said to be hydroxyl groups only in the case of the lower molecular weight species. Unlike most polymer systems, polyethylene oxide is commercially available in an extraordinarily wide range of molecule weights from ethylene glycol, diethylene glycol, and so on, up to polymers that have molecular weights many times greater than a million. The lower molecular weight members of the series with n up to about 130 (molecular weight from about 200 to about 6000) are generally known as polyethylene glycols while the higher members (molecular weight greater than 6500 up to 100,000 to several million) are known as polyethylene oxide, polyoxyethylene, or polyoxirane. The preferred polyethylene oxide polymers for use in the present invention have a molecular weight of at least about 200,000 and, theoretically, there is no maximum.

The higher (polyethylene oxide) and lower (polyethylene glycol) molecular weight members of this series differ sufficiently in properties as to form two classes. The lower members range from relatively viscous fluids to wax-like solids while the higher members are true thermoplastics capable of being formed into tough, molded shapes. The property differences of these two classes are due principally to large differences in molecular weight and the relatively greater importance, therefore, of the end groups in the low molecular weight class.

The polyethylene oxide polymers used in the present invention are made by conventional processes such as suspension polymerization or condensation of ethylene oxide. The composition of the present invention is prepared by dissolving the proper amount of polyethylene oxide in a measured amount of water. This may be accomplished by any conventional method, but I have found that simply mixing the polyethylene oxide in warm water (30° C. to 70° C.) is sufficient to provide the desired composition.

As previously stated, the composition of the present invention is comprised of from at least about 2 percent polyethylene oxide and the balance water. If less than about 2 percent polyethylene oxide is used, then the spontaneous combustion potential is too high. Theoretically, there is no maximum but usually more than 20 percent is not necessary.

The preferred method for treating coal to reduce its spontaneous combustion potential according to the present invention comprises spraying the above-described solution on the coal so that it completely covers the coal. Another preferred method comprises completely immersing coal in a solution of polyethylene oxide and water in the indicated concentration range. It is important that the coal is completely coated with the composition. Next, if the immersion method has been used, the polyethylene oxide solution is decanted from the coal. Any means of removing the solution from the coal may be used except water washing. Finally, the coal is exposed to ambient conditions to allow the liquid to evaporate for at least about 2 hours.

It is theorized that the composition and method of the present invention provide the desired reduction in the spontaneous combustion tendency to sealing the coal from oxygen and sealing the volatile hydrocarbons in the coal, thereby preventing oxidation thereof.

The following example is intended to illustrate the invention and not to limit it in any way.

EXAMPLE

The polyethylene oxide used in this example was Union Carbide POLYOX® WSR-1105 and has an approximate molecular weight of 900,000 and a 5 percent solution viscosity of 800 to 17,600 centipoises at 25° C. Solutions of one percent, two percent, three percent, and four percent polyethylene oxide in water were prepared by mixing the appropriate amount of polyethylene oxide in the appropriate amount of warm (50° C.) water. Ten grams of lignite coal was added to each solution and the mixtures were stirred vigorously for 15 minutes. After the mixing, the polyethylene oxide solution was decanted and the coal was allowed to dry in the open air at ambient temperature for 24 hours.

Separate samples of each of the separately treated coals were exposed to combustion conditions at the varying temperatures and the time it took for combustion to occur was recorded.

| | Seconds to Combustion | | | | | | |
|---|---|---|---|---|---|---|---|
| % PEO | 330° C. | 340° C. | 350° C. | 360° C. | 370° C. | 380° C. | 390° C. |
| 0(Control) | 53 | 33 | — | 25 | 18.5 | 16 | 12 |
| 1 | 47 | 37 | 37 | 30 | 25 | — | — |
| 2 | no comb. | 55 | 41 | 30 | 25 | — | — |
| 3 | 71 | 45 | 33 | 25 | 18.5 | — | — |
| 4 | 48 | 33 | 20 | 12 | 7 | — | — |

I have developed a method for predicting the spontaneous combustion tendency of coal. A thermo-gravimetric analysis was done on each sample by placing it in a Perkin-Elmer TGS-II and causing pure oxygen to flow through the furnace chamber at 30 cubic centimeters per minute. The samples were then heated to the test temperature at 320° C. per minute and the time until combustion occurred was recorded. This procedure was repeated for each coal sample at a variety of temperatures. The resulting data for each sample was fitted into the Arrhenius Relationship and plotted against a logarithmic time base. The resulting line was then extrapolated to near ambient temperature (25° C.) and the expected life span noted. The relative spontaneous combustion potential is defined as one divided by the logarithm (base 10) of the expected life span.

The relative spontaneous combustion potential has a direct relationship to spontaneous combustion. In other words, the lower the number, the less likely combustion will occur under ambient conditions. The control sample had a relative combustion potential of 0.125. The sample treated with one percent PEO had a relative combustion potential of 0.164. The sample treated with 2 percent PEO had a relative combustion potential of 0.108. Finally, the sample treated with 4 percent PEO had a relative combustion potential of 0.074. Thus, it can be seen that treating the coal with a solution of polyethylene oxide of a concentration greater than 2 percent reduces the relative spontaneous combustion potential and therefore decreases the spontaneous combustion tendency of the coal.

I claim:

1. A method for decreasing the spontaneous combustion tendency of coal which comprises contacting the coal with a composition comprised of at least about 2 percent polyethylene oxide and the balance water, and then drying the coal.

2. The method of claim 1 wherein the coal is immersed in said composition.

3. The method of claim 2 wherein the drying is accomplished by allowing the treated coal to dry in the open air at ambient temperature for at least about 2 hours.

4. The method of claim 1 wherein said composition is sprayed onto the coal.

5. The method of claim 4 wherein drying is accomplished by allowing the coal to dry in the open air at ambient temperature for at least about 2 hours.

* * * * *